US006145606A

United States Patent [19]

Haga

[11] Patent Number: 6,145,606

[45] Date of Patent: Nov. 14, 2000

[54] CUTTING INSERT FOR ROOF DRILL BIT

[75] Inventor: Phillip W. Haga, Chilhowie, Va.

[73] Assignee: Kennametal Inc., Latrobe, Pa.

[21] Appl. No.: 09/264,291

[22] Filed: Mar. 8, 1999

[51] Int. Cl.[7] ..... E21B 10/46; E21B 10/36

[52] U.S. Cl. ..... 175/420.1; 175/427

[58] Field of Search ..... 175/420.1, 427

[56] References Cited

U.S. PATENT DOCUMENTS

| | | | |
|---|---|---|---|
| 3,163,246 | 12/1964 | Vagins et al. | 175/420.1 |
| 4,342,368 | 8/1982 | Denman | 175/420.1 |
| 4,489,796 | 12/1984 | Sanchez et al. | 175/410 |
| 4,527,638 | 7/1985 | Sanchez et al. | 175/57 |
| 4,603,751 | 8/1986 | Erickson | 175/410 |
| 4,787,464 | 11/1988 | Ojanen | 175/57 |
| 5,172,775 | 12/1992 | Sheirer et al. | 175/57 |
| 5,184,689 | 2/1993 | Sheirer et al. | 175/420.1 |
| 5,220,967 | 6/1993 | Monyak | 175/420.1 |
| 5,269,387 | 12/1993 | Nance | 175/420.1 |
| 5,375,672 | 12/1994 | Peay et al. | 175/420.1 |
| 5,400,861 | 3/1995 | Sheirer | 175/427 |
| 5,829,540 | 11/1998 | Peay et al. | 175/420.1 |
| 5,996,715 | 12/1999 | Peay et al. | 175/420.1 |

FOREIGN PATENT DOCUMENTS 2280627 2/1995 United Kingdom .

OTHER PUBLICATIONS

Kennametal Mining Products Catalog A96–55(15) (1996) [36 pages].

Cutting insert of Figs. A1–A4 on attached sheet.

Cutting insert of Figs. B1–B5 on attached sheet.

*Primary Examiner*—Hoang Dang
*Attorney, Agent, or Firm*—John J. Prizzi

[57] ABSTRACT

A rotatable cutting bit for engaging earth strata wherein the bit comprises an elongate bit body rotatable about a central longitudinal axis. The elongate body has an axially forward end and an axially rearward end. A cutting insert is affixed to the elongate body at the axially forward end thereof. The cutting insert comprises a pair of top surfaces which intersect to form a chisel edge, and a pair of concave surfaces wherein each one of the concave surfaces is adjacent to and intersects its corresponding one of the top surfaces. The cutting insert further includes a pair of end surfaces and a pair of arcuate surfaces. One of the arcuate surfaces intersects the one top surface and further intersects the one end surface whereby the one arcuate surface joins the one top surface and the one end surface. The other of the arcuate surfaces intersects the other top surface and further intersects the other end surface whereby the other arcuate surface joins the other top surface and the other end surface.

22 Claims, 3 Drawing Sheets

CUTTING INSERT FOR ROOF DRILL BIT

BACKGROUND OF THE INVENTION

The expansion of an underground mine (e.g. a coal mine) requires digging a tunnel which initially has an unsupported roof. To stabilize and support the roof a roof bolt must be inserted into the roof to provide support. The operator must first drill holes in the roof through the use of a rotatable cutting bit or roof drill bit. A roof bolt is then inserted into each one of the holes.

A common roof drill bit design uses a cutting insert that has been brazed into a slot at the axially forward end of the roof drill bit body. U.S. Pat. No. 5,400,861 to Sheirer discloses various roof drill bits. U.S. Pat. No. 4,603,751 Erickson also discloses various roof drill bits. Applicants hereby incorporate U.S. Pat. No. 4,603,751 and U.S. Pat. No. 5,400,861 by reference herein.

In addition, the following catalogs published by Kennametal Inc. of Latrobe, Pennsylvania (U.S.A.), which are hereby incorporated by reference herein, disclose roof drill bits: "Kennametal Mining Products", Catalog A96-55(15) H6 (September 1996) [36 pages in length], and "Kennametal Mining Products" Catalog B92-75R(3)M5 (1992) [36 pages in length].

Other United States patents that disclose roof drill bits and cutting inserts for roof drill bits include U.S. Pat. No. 4,489,796 to Sanchez et al., U.S. Pat. No. 4,527,638 to Sanchez et al., U.S. Pat. No. 4,787,464 to Ojanen, U.S. Pat. No. 5,172,775 to Sheirer et al., U.S. Pat. No. 5,269,387 to Nance, U.S. Pat. No. 5,375,672 to Peay et al., and U.K. Pat. Application No. 2,280,627 to Peay et al.

While some of the earlier roof drill bits provide acceptable performance characteristics, there remains the desire to improve upon these characteristics. In this regard, roof drill bits which have a higher penetration rate for the drilling operation are desirable because it typically takes less time to drill the required number of holes in the mine roof (i.e., earth strata) with such a roof drill bit. A roof drill bit which uses a cutting insert wherein the cutting insert is of a design so as to reduce the resistance to penetration enhances the potential to maintain a higher penetration rate at a given thrust level for a longer time.

It thus would be desirable to provide an improved roof drill bit, as well as an improved cutting insert for the roof drill bit, that has a high penetration rate wherein such roof drill bit uses a cutting insert of such a design so as to reduce the resistance to penetration during the drilling operation.

SUMMARY

In one form thereof, the invention is a rotatable cutting bit for engaging earth strata wherein the bit comprises an elongate bit body rotatable about a central longitudinal axis. The elongate body has an axially forward end and an axially rearward end. A cutting insert is affixed to the elongate body at the axially forward end thereof. The cutting insert comprises a pair of top surfaces which intersect to form a chisel edge, and a pair of concave surfaces wherein each one of the concave surfaces is adjacent to and intersects its corresponding one of the top surfaces. The cutting insert further includes a pair of end surfaces and a pair of arcuate surfaces. One of the arcuate surfaces intersects the one top surface and further intersects the one end surface whereby the one arcuate surface joins the one top surface and the one end surface. The other of the arcuate surfaces intersects the other top surface and further intersects the other end surface whereby the other arcuate surface joins the other top surface and the other end surface.

In another form thereof, the invention is a cutting insert for use with a rotatable cutting bit for engaging the earth strata. The cutting insert comprises a pair of top surfaces which intersect to form a chisel edge, and a pair of concave surfaces wherein each one of the concave surfaces is adjacent to and intersects its corresponding one of the top surfaces. The cutting insert further includes a pair of end surfaces and a pair of arcuate surfaces. One of the arcuate surfaces intersects the one top surface and further intersects the one end surface whereby the one arcuate surface joins the one top surface and the one end surface. The other of the arcuate surfaces intersects the other top surface and further intersects the other end surface whereby the other arcuate surface joins the other top surface and the other end surface.

BRIEF DESCRIPTION OF THE DRAWINGS

The following is a brief description of the drawings that form a part of this patent application.

DETAILED DESCRIPTION

Figure 1:
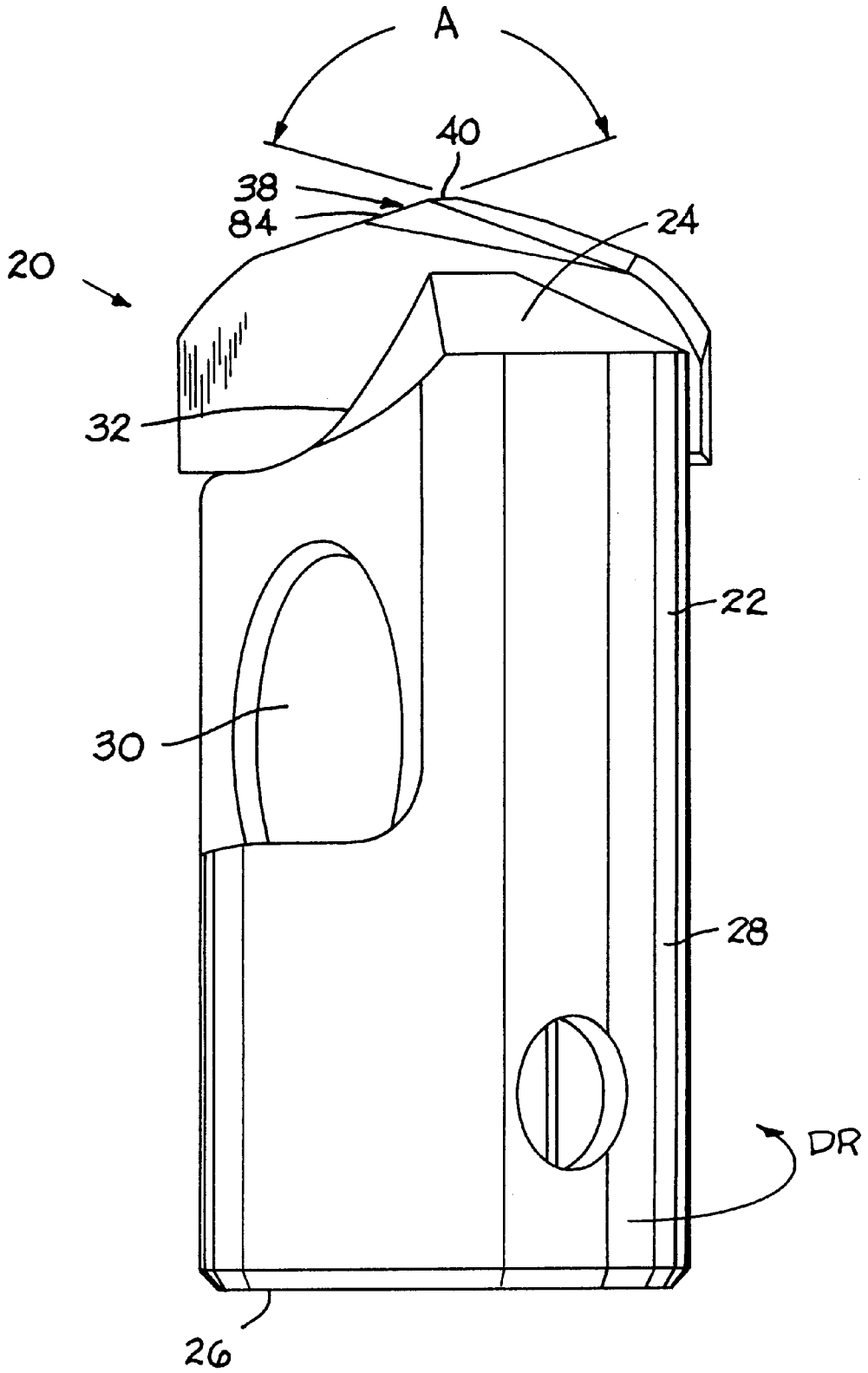
FIG. 1 is a side view of a roof drill bit having a cutting insert attached to the elongate body thereof.
Figure 2:
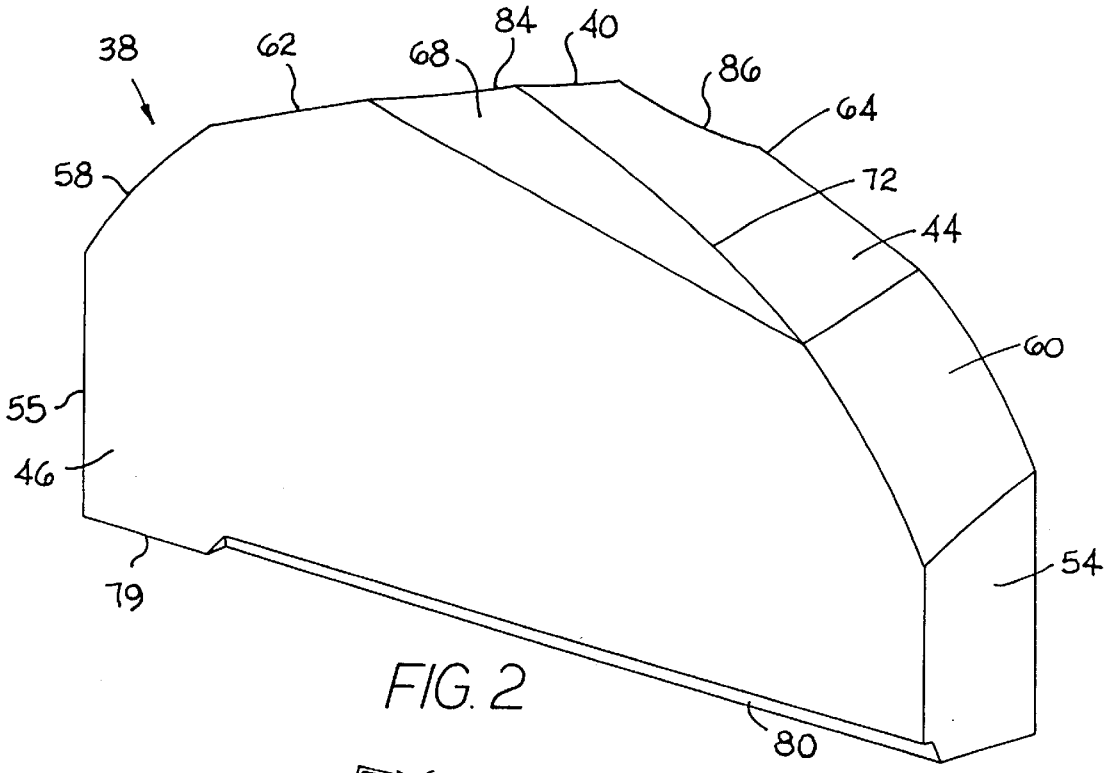
FIG. 2 is an isometric view of the cutting insert shown in FIG. 1.

Referring to the drawings, there is illustrated a roof drill bit, i.e, a rotatable cutting bit, generally designated as 20. Roof drill bit 20 has an elongate body 22 typically made of steel. Elongate body 22 has an axially forward end 24 and an opposite axially rearward end 26. Elongate body 22 further presents a generally cylindrical peripheral surface 28. Elongate body 22 contains a pair of debris evacuation passages 30 in the peripheral surface 28.

The elongate body 22 also contains a diametrical slot 32 at the forward end 24 thereof. A cutting insert 38 is attached by brazing to the elongate body 22 at the slot 32 so that the cutting insert 38 is contained within the slot 32.

Cutting insert 38 is typically made from a cobalt cemented tungsten carbide material. More specifically, typical compositions of the cobalt cemented tungsten carbide have between about 5 and about 15 weight percent cobalt with the balance being tungsten carbide. The grain size of the tungsten carbide may range between about 1 micrometer to about 12 micrometer. The cutting insert may optionally include additives such as transition metal carbides. The preferred cobalt cemented tungsten carbide has 6 weight percent cobalt with the balance being tungsten carbide having a grain size between about 1 micrometer to about 12 micrometer.

As previously mentioned, the cutting insert is brazed into the slot. One preferred braze alloy comprises HANDY HI-TEMP 548 braze alloy available from Handy & Harman, Inc., 859 Third Avenue, New York, N.Y. 10022. HANDY HI-TEMP 548 braze alloy is composed of 55±1.0 weight percent Cu, 6±0.5 weight percent Ni, 4±0.5 weight percent Mn, 0.15±0.05 weight percent Si, with the balance zinc and 0.50 weight percent maximum total impurities. Further information on HANDY HI-TEMP 548 braze alloy can be found in Handy & Harman Technical Data Sheet No. D-74 available from Handy & Harman, Inc.

Referring to the geometry of the cutting insert 38, cutting insert 38 has a chisel edge 40 wherein a pair of opposite top surfaces 42 and 44 are disposed on either side of the chisel edge 40. The top surfaces (42, 44) intersect to form the chisel edge 40. The top surfaces (42, 44) are disposed with respect to one another at an included angle "A" (see FIG. 1) of about 140 degrees.

Figure 4:
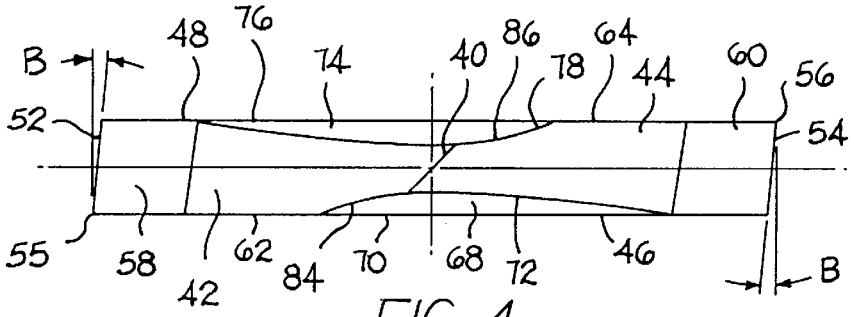
FIG. 4 is a top view of the cutting insert as shown in FIG. 1.

The cutting insert 38 further has a pair of side surfaces 46, 48. The side surfaces (46, 48) are generally parallel to one another. The cutting insert 38 also has a pair of generally parallel end surfaces 52, 54 wherein the end surfaces (52, 54) join together the side surfaces (46, 48). The one end surface 52 intersects the one side surface 46 to form one side clearance cutting edge 55. The other end surface 54 intersects the other side surface 48 to form the other side clearance cutting edge 56. The end surfaces (52, 54) each are disposed at a relief angle "B" (see FIG. 4) of about 6.5 degrees. Relief angle "B" is the included angle between the end surface and a vertical plane perpendicular to the side surfaces (46, 48) of the cutting insert 38.

Figure 8:
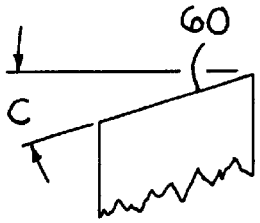
FIG. 8 is a view of the cutting insert taken along line 8—8 of FIG. 3.
Figure 10:
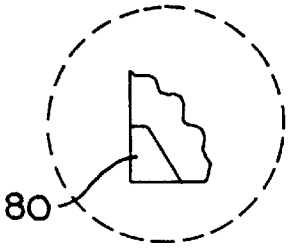
FIG. 10 is a detail view of the notch along the bottom surface of the cutting insert of FIG. 9.

The cutting insert 38 has one arcuate surface portion 58 that joins the one top surface 42 with the one end surface 52. Arcuate surface 58 is disposed with respect to a plane perpendicular to the side surface, i.e., a horizontal plane, at an included angle equal to about 18 degrees. Another arcuate surface 60 joins the other top surface 44 with the other end surface 54. Arcuate surface 60 is disposed with respect to a plane perpendicular to the side surface, i.e., a horizontal plane, at an included angle "C" (see FIG. 8) equal to about 18 degrees.

Figure 3:
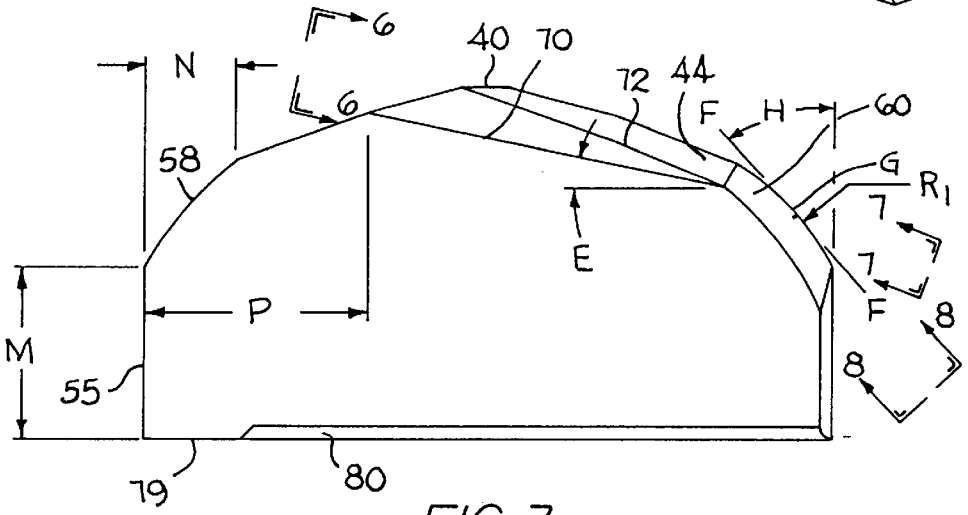
FIG. 3 is a side view of the cutting insert shown in FIG. 1.

Each arcuate surface (58, 60) is further disposed so that the tangent F—F (see FIG. 3) to each arcuate surface passing through the midpoint "G" (see FIG. 3) along the circumference thereof has an included angle of disposition "H" (see FIG. 3) with respect to the vertical equal to about 45 degrees.

Figure 7:
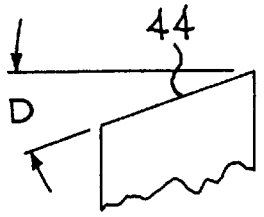
FIG. 7 is a view of the cutting insert taken along line 7—7 of FIG. 3.

Each one of the top surfaces (42, 44) is disposed with respect to a plane perpendicular to the side surface, i.e., a horizontal plane, at an included angle "D" of about 18 degrees (see FIG. 7).

The one side surface 46 intersects the one top surface 42 to form a leading cutting edge 62. The other side surface 48 intersects the other top surface 44 to form a trailing cutting edge 64. Referring to FIG. 1, the arrow designated "DR" indicates the direction of rotation of the roof drill bit during operation.

The cutting insert 38 further has one concave surface 68 which joins the one side surface 46 with the other top surface 44. The one concave surface 68 intersects the one side surface 46 to form an edge 70. The edge 70 is disposed at an angle "E" (see FIG. 3) with respect to a horizontal line that is equal to about 12 degrees. The one concave surface 68 intersects the one top surface 42 to form another edge 72.

Another concave surface 74 joins the other side surface 48 with the one top surface 46. The other concave surface 74 intersects the one side surface to form an edge 76. The edge 76 is disposed at an angle with respect to a horizontal line equal to about 12 degrees. The other concave surface 74 intersects the other top surface 44 to form another edge 78.

The one concave surface 74 intersects the one top surface 46 so as to form one scallop 84 at the intersection thereof. It becomes apparent that the leading cutting edge 62 presents three separate portions (or lengths). These portions comprise an arcuate portion which is defined by the edge at the intersection of the one side surface 46 and the arcuate surface 58, a scalloped portion which is defined by the intersection of the one concave surface with the one top surface 42, and a straight portion which is mediate of the arcuate portion and the scalloped portion wherein the straight portion is defined by the intersection of the one side surface 46 and the one top surface 42.

The other concave surface 76 intersects the other top surface 48 as to form another scallop 86 at the intersection thereof. Like for the leading cutting edge 62, it becomes apparent that the trailing cutting edge 64 presents three separate portions (or lengths). These portions comprise an arcuate portion which is defined by the edge at the intersection of the other side surface 48 and the arcuate surface 60, a scalloped portion which is defined by the intersection of the other concave surface with the other top surface 44, and a straight portion which is mediate of the arcuate portion and the scalloped portion wherein the straight portion is defined by the intersection of the other side surface 48 and the other top surface 44.

The cutting insert has a bottom surface 79. Bottom surface 79 contains a pair of opposite elongate notches 80, 82 therein.

Figure 5:
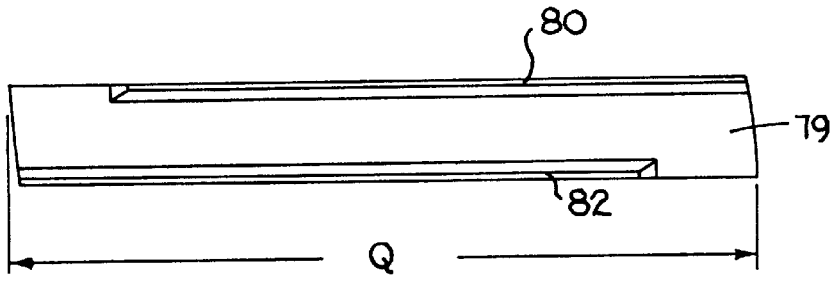
FIG. 5 is a bottom view of the cutting insert shown in FIG. 1.
Figure 9:
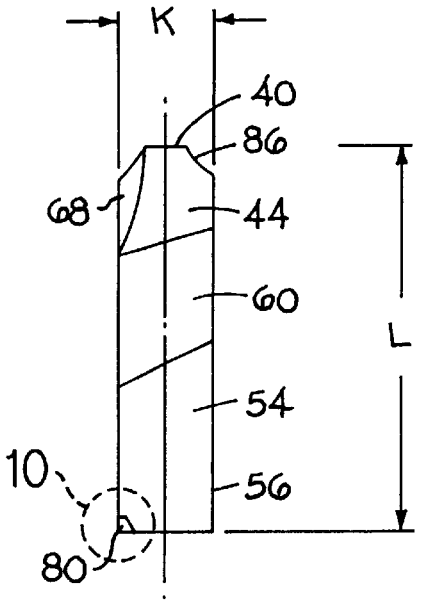
FIG. 9 is an end view of the cutting insert shown in FIG. 1.

The thickness of the cutting insert 38 as measured from the opposite side surfaces (46, 48) is designated as "K" (see FIG. 9). The height of the cutting insert 38 as measured from the chisel edge 40 to the bottom surface 79 is designated as "L" (see FIG. 9). The vertical height of the side clearance cutting edges (55, 56) is designated as "M" (see FIG. 3). The horizontal dimension of the arcuate surfaces (58, 60) is designated as "N" (see FIG. 3). The horizontal distance between the one side clearance cutting edge 55 and the closest point where the corresponding concave surface 68 intersects the one top surface 42 is designated as "P" (see FIG. 3). The length of the cutting insert 38 as measured at the bottom surface 79 from the one side clearance cutting edge 55 to the other side clearance cutting edge 56 is a distance "Q" (see FIG. 5).

Figure 6:
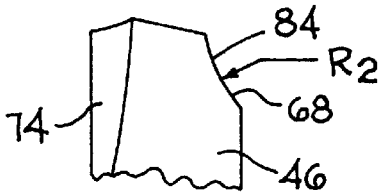
FIG. 6 is a view of the cutting insert taken along line 6—6 of FIG. 3.

Each arcuate surface (58, 60) has a radius of curvature $R_1$ (see FIG. 3) equal to about 10.6 percent of the height "L" of the cutting insert 38 as measured from the chisel edge 40 to the bottom surface 79. Each concave surface (68, 70) has a radius of curvature $R_2$ (see FIG. 6) equal to about 21.2 percent of the height "L" of the cutting insert 38 as measured from the chisel edge 40 to the bottom surface 79. The horizontal dimension "N" of the arcuate surface 58 is about 14 percent of the length of the cutting insert 38 as indicated by dimension "Q". The radius of curvature $R_2$ of each concave surface (68, 70) is equal to about 10.8 percent of the thickness "K" of the cutting insert 38.

Table I below sets forth the dimensions for an exemplary preferred cutting insert.

TABLE I

Dimensions for an Exemplary Cutting Insert

| Dimension | Magnitude (inches) |
|---|---|
| K | .186 |
| L | .703 |
| M | .345 |
| N | .194 |
| P | .450 |
| Q | 1.383 |
| $R_1$ | .75 |
| $R_2$ | .20 |

In operation, the roof drill bit 20 is connected at its axially rearward end 24 to a drill steel (not illustrated) wherein rotational movement is translated to the roof drill bit 20 via the drill steel. In regard to the operating parameters of the roof drill bit, the roof drill bit may operate at a thrust pressure between about 1000 pounds to about 10,000 pounds and at a speed between about 250 revolutions per minute (rpm) and 650 rpm. These operating parameters include the operation of the roof drill bit at a moderate thrust pressure of between about 4500 pounds to about 5000 pounds and a moderate speed of between about 450 rpm to about 500 rpm. Further, these operating parameters includes the operation of the roof drill bit at a high thrust pressure of between about 7000 pounds to about 8500 pounds and a high speed of between about 600 rpm to about 650 rpm.

The rotating roof drill bit 20 engages the earth strata (e.g., the mine roof) in such a fashion that the chisel edge 40 first contacts the earth strata. As the rotating roof drill bit 20 is forced into the earth strata the leading cutting edge 62 (which includes the scalloped portion, the straight portion, and the arcuate portion) and the trailing cutting edge 64 (which includes the scalloped portion, the straight portion, and the arcuate portion) engage the earth strata. Finally, the side clearance cutting edges (55, 56) engage the earth strata to cut the sides of the bore hole.

Because of the presence of the arcuate surface portions (58, 60), which in part define the arcuate portions of the leading and trailing cutting edges, there is less resistance to the penetration of the roof drill bit 20 into the earth strata. The existence of less resistance results in better performance of the roof drill bit.

The presence of the concave surfaces (68, 74), which in part define the scalloped portions of the leading and trailing cutting edges, also results in less resistance to the penetration of the roof drill bit 20 into the earth strata. Again, the existence of less resistance results in better performance of the roof drill bit.

The presence of the concave surfaces (68, 74) also provide for a zero to a negative cutting rake angle. By providing a zero to a negative cutting rake angle there is an enhancement of the strength of the cutting point of the cutting insert.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A rotatable cutting bit for engaging earth strata, the bit comprising:

an elongate bit body rotatable about a central longitudinal axis, the elongate body having an axially forward end and an axially rearward end;

a cutting insert being affixed to the elongate body at the axially forward end thereof;

the cutting insert comprising:

a pair of top surfaces which intersect to form a chisel edge, and a pair of concave surfaces wherein each one of the concave surfaces is adjacent to and intersects its corresponding one of the top surfaces;

a pair of end surfaces; and a pair of arcuate surfaces, and one of the arcuate surfaces intersecting the one top surface and further intersecting the one end surface whereby the one arcuate surface joins the one top surface and the one end surface, and other of the arcuate surfaces intersecting the other top surface and further intersecting the other end surface whereby the other arcuate surface joins the other top surface and the other end surface.

2. The rotatable cutting bit of claim 1 wherein the one concave surface intersects the other top surface and the one side surface so as to join the other top surface to the one side surface.

3. The rotatable cutting bit of claim 1 wherein the other concave surface intersects the one top surface and the other side surface so as to join the one top surface to the other side surface.

4. The rotatable cutting bit of claim 1 wherein the one top surface intersects the one concave surface so as to define a portion of the leading cutting edge that presents a scallop.

5. The rotatable cutting bit of claim 4 wherein the one arcuate surface intersects the one side surface to define a portion of the leading cutting edge that present an arcuate portion.

6. The rotatable cutting bit of claim 5 wherein the portion of the leading cutting edge mediate of the scalloped portion and the arcuate portion of the leading cutting edge comprises a straight portion.

7. The rotatable cutting bit of claim 1 wherein the other top surface intersects the other concave surface so as to define a portion of the trailing cutting edge that presents a scallop.

8. The rotatable cutting bit of claim 7 wherein the other arcuate surface intersects the other side surface to define a portion of the trailing cutting edge that presents an arcuate portion.

9. The rotatable cutting bit of claim 8 wherein the portion of the trailing cutting edge mediate of the scalloped portion and the arcuate portion of the trailing cutting edge comprises a straight portion.

10. A cutting insert for use with a rotatable cutting bit for engaging the earth strata, the cutting insert comprises:

a pair of top surfaces which intersect to form a chisel edge, and a pair of concave surfaces wherein each one of the concave surfaces is adjacent to and intersects its corresponding one of the top surfaces;

a pair of end surfaces; and a pair of arcuate surfaces, and one of the arcuate surfaces intersecting the one top surface and further intersecting the one end surface whereby the one arcuate surface joins the one top surface and the one end surface, and other of the arcuate surfaces intersecting the other top surface and further intersecting the other end surface whereby the other arcuate surface joins the other top surface and the other end surface.

11. The cutting insert of claim 10 wherein the one concave surface intersects the other top surface and the one side surface so as to join the other top surface to the one side surface.

12. The cutting insert of claim 10 wherein the other concave surface intersects the one top surface and the other side surface so as to join the one top surface to the other side surface.

13. The cutting insert of claim 10 wherein the one top surface intersects the one concave surface so as to define a portion of the leading cutting edge that presents a scallop.

14. The cutting insert of claim 13 wherein the one arcuate surface intersects the one side surface to define a portion of the leading cutting edge that present an arcuate portion.

15. The cutting insert of claim 14 wherein the portion of the leading cutting edge mediate of the scalloped portion and the arcuate portion of the leading cutting edge comprises a straight portion.

16. The cutting insert of claim 10 wherein the other top surface intersects the other concave surface so as to define a portion of the trailing cutting edge that presents a scallop.

17. The cutting insert of claim 16 wherein the other arcuate surface intersects the other side surface to define a portion of the trailing cutting edge that presents an arcuate portion.

18. The cutting insert of claim 17 wherein the portion of the trailing cutting edge mediate of the scalloped portion and the arcuate portion of the trailing cutting edge comprises a straight portion.

19. A roof drill bit wherein the roof drill bit is rotated at a speed and is applied against the earth strata at a thrust pressure so as to drill holes in the earth strata, the roof drill bit comprising:

an elongate bit body rotatable about a central longitudinal axis, the elongate body having an axially forward end and an axially rearward end;

a cutting insert being affixed to the elongate body at the axially forward end thereof;

the cutting insert comprising:

a pair of top surfaces which intersect to form a chisel edge, and a pair of concave surfaces wherein each one of the concave surfaces is adjacent to and intersects its corresponding one of the top surfaces;

a pair of end surfaces; and a pair of arcuate surfaces, and one of the arcuate surfaces intersecting the one top surface and further intersecting the one end surface whereby the one arcuate surface joins the one top surface and the one end surface, and other of the arcuate surfaces intersecting the other top surface and further intersecting the other end surface whereby the other arcuate surface joins the other top surface and the other end surface.

20. The roof drill bit of claim 19 wherein the roof drill bit operates at a speed of between about 250 rpm and about 650 rpm and at a thrust pressure of between about 1000 pounds and about 10,000 pounds.

21. The roof drill bit of claim 20 wherein the roof drill bit operates at a speed of between about 600 rpm and about 650 rpm and at a thrust pressure of between about 7000 pounds and about 8500 pounds.

22. The roof drill bit of claim 20 wherein the roof drill bit operates at a speed of between about 450 rpm and about 500 rpm and at a thrust pressure of between about 4500 pounds and about 5000 pounds.

* * * * *